United States Patent [19]

Grossman et al.

[11] Patent Number: 5,006,165

[45] Date of Patent: Apr. 9, 1991

[54] METHOD FOR MERCURY REFINEMENT

[75] Inventors: Mark W. Grossman, Belmont; Richard Speer, Reading; William A. George, Rockport, all of Mass.

[73] Assignee: GTE Products Corporation, Danvers, Mass.

[21] Appl. No.: 289,640

[22] Filed: Dec. 23, 1988

[51] Int. Cl.[5] ..... C22B 43/00

[52] U.S. Cl. ..... 75/407; 75/742; 210/660; 210/807; 210/914

[58] Field of Search ..... 75/81, 742, 407; 210/688, 914, 660, 807; 423/99, DIG. 7

[56] References Cited

U.S. PATENT DOCUMENTS

| | | | |
|---|---|---|---|
| 3,344,924 | 10/1967 | Messer et al. | 75/81 |
| 3,379,252 | 4/1983 | Work | 313/485 |
| 3,897,331 | 7/1975 | Smith et al. | 209/10 |
| 3,983,019 | 9/1976 | Botter nee Bergheaud R | 204/1571 |
| 4,435,284 | 3/1984 | Heytmeijer | 210/914 |
| 4,514,363 | 4/1985 | Durbin | 423/3 |
| 4,527,086 | 7/1985 | Maya | 313/485 |
| 4,648,951 | 3/1987 | Maya | 204/157.21 |
| 4,678,550 | 7/1987 | Grossman | 204/105 R |
| 4,713,547 | 12/1987 | Grossman | 250/373 |

FOREIGN PATENT DOCUMENTS

| | | | |
|---|---|---|---|
| 280788 | 9/1988 | European Pat. Off. . | |
| 281687 | 9/1988 | European Pat. Off. . | |
| 3335127 | 4/1985 | Fed. Rep. of Germany | 423/99 |
| 2561941 | 10/1985 | France | 210/807 |
| 21553 | 9/1969 | Japan | 210/914 |

OTHER PUBLICATIONS

Waymouth, *Electric Discharge Lamps*, MIT Press (1971).

Webster and Zare, *J. Phys. Chem.* 85: 1302–1305 (1981).

McDowell et al., *Can. J. Chem.*, 37: 1432 (1959).

Gunning & Swartz, *Adv. Photochem.*, 1:209 (1963).

*Primary Examiner*—Melvyn J. Andrews

*Attorney, Agent, or Firm*—Ernest V. Linek

[57] ABSTRACT

The effluent from mercury collected during the photochemical separation of the $^{196}Hg$ isotope is often contaminated with particulate mercurous chloride, $Hg_2Cl_2$. The use of mechanical filtering via thin glass tubes, ultrasonic rinsing with acetone (dimethyl ketone) and a specially designed cold trap have been found effective in removing the particulate (i.e., solid) $Hg_2Cl_2$ contaminant. The present invention is particularly directed to such filtering.

5 Claims, 2 Drawing Sheets

METHOD FOR MERCURY REFINEMENT

STATEMENT OF GOVERNMENT INTEREST

The Government of the United States of America has rights in this invention pursuant to Subcontract 4540710 under Prime Contract DE-AC03-76SF00098 awarded by the Department of Energy.

FIELD OF THE INVENTION

The present invention is directed to a method and apparatus useful in conjunction with the isotopic enrichment of a predetermined isotope of mercury (Hg) from a naturally occurring mercury mixture. While the present invention may be used in conjunction with the enrichment of any one of the seven naturally occurring isotopes of mercury ($^{202}Hg$, $^{200}Hg$, $^{199}Hg$, $^{201}Hg$, $^{198}Hg$, $^{204}Hg$, and $^{196}Hg$,) it has particularly advantageous application in conjunction with the enrichment of the $^{196}Hg$ isotope, which has a natural abundance of only about 0.146 percent.

BACKGROUND OF THE INVENTION

Many devices utilize mercury in their operation, particularly in the field of electric lamps and lighting. Such devices include arc discharge lamps which typically employ mercury as one of the vaporizable components therein. See, for example, Waymouth, *Electric Discharge Lamps*, MIT Press 1971 for a description of the basic principles of such lamps.

In U.S. Pat. No. 4,379,252, (the '252 patent), the advantages of utilizing higher than normal levels of $^{196}Hg$ in the Hg added to fluorescent lamps are described and include unexpectedly high efficiency gains in light output. The disclosure of this patent is hereby incorporated herein by reference.

The drawback of using this isotope lies in its high cost. For example, using conventional enrichment techniques, mercury which has been enhanced to contain about 35% of the $^{196}Hg$ isotope can cost about $500 per milligram. While only sub-milligram quantities of this isotope need be added to an incandescent lamp to afford beneficial results, economic realities always play a part in consumer products. Accordingly, it is easy to understand why more economical methods of obtaining this isotope continue to be sought.

Isotopically enriched mercury can be produced by a number of methods. One method involves photosensitized chemical reactions utilizing elemental mercury and various compounds. The compounds HCl and $0_2$ react with mercury atoms when the mercury atoms are excited by resonance radiation, in particular, 2537Å radiation produced in a Hg ($^3P$ - $^1S_o$) transition generating isotopically selective reactions. Thus, the Hg compound formed contains Hg enriched in a particular isotope, and the Hg must be separated from the compound into its free state in order to recover the isotopically enriched metal.

Although it has been possible to separate mercury from mercury compounds by a number of techniques, previously employed techniques suffer from significant disadvantages. For example, it has been possible to separate Hg from $Hg_2Cl_2$ via electroless methods using a mixture of methanol and HCl as an electrolyte solution. However, this method produced low yields and the electrolyte solution had a tendency to become contaminated with impurities and to become blackened and corroded.

Hg can also be separated from HgO via thermal decomposition. However, this requires high temperature baking [T>500° C.]and it can easily result in the introduction of trace impurities into mercury. Additionally, vacuum baking at high temperatures requires hardware and techniques that are very complex.

The following additional documents are recited as general background information with respect to the subject matter of the present invention. To the extent deemed necessary by artisans of ordinary skill in the art to which this invention pertains, the teachings of these documents are hereby incorporated herein by reference.

Grossman, U.S. Pat. No. 4,713,547;
Grossman et al., U.S. Pat. No. 4,678,550;
Maya, U.S. Pat. No. 4,527,086;
Durbin, U.S. Pat. No. 4,514,363;
Work et al., U.S. Pat. No. 3,379,252;
Botter nee Bergheaud et al., U.S. Pat. No. 3,983,019;
Smith et al., U.S. Pat. No. 3,897,331;
Grossman et al., U.S. Ser. No. 815,150, filed, 31 Dec. 1985 now abandoned in favor of continuation U.S. Ser. No. 295,425 filed 7 Oct. 1988 now U.S. Pat. No. 4,879,010;
European Patent Publication No. 0 281 687, published 14 Sept. 1988, claiming priority of U.S. Ser. No. 947,217, filed 29 Dec. 1986 now U.S. Pat. No. 4,789,784 and
European Patent Publication No. 0 280 788, published 7 Sept. 1988, claiming priority of U.S. Ser. No. 947,216, filed 29 Dec. 1986 now U.S. Pat. No. 4,800,284.

SUMMARY OF THE INVENTION

It has been discovered that most effluent samples from a $^{196}Hg$ photochemical isotope enrichment processes forming $Hg_2Cl_2$ as a product, contain mercury with varying trace quantities of particulate mercurous chloride, $Hg_2Cl_2$. Particularly in the case of multipass systems where the feedstock is enriched in $^{196}Hg$ for all but the first pass this trace impurity needs to be removed. This is true since the effluent in all but the first pass could have an $^{196}Hg$ concentration higher than natural mercury and thus should be re-used in a feedstock.

Thus, the present invention is directed to a method of purifying such contaminated mercury effluents, by the use of mechanical filtering means e.g., thin glass tubes, for the removal of the particulates such as $Hg_2Cl_2$, from this effluent mercury. It has also been discovered that ultrasonic rinsing with acetone (dimethyl ketone) and a specially designed cold trap are also particularly effective in removing this $Hg_2Cl_2$ contamination from such mercury effluents.

DETAILED DESCRIPTION OF THE PREFERRED EMBODIMENTS

Photochemical mercury enrichment processes are well known and have been well documented in the literature. See for example, Webster and Zare, *J. Phys. Chem.*, 85: 1302 (1981); McDowell et al., *Can. J. Chem.*, 7: 1432 (1959); Gunning and Swartz, *Adv. Photochem.*, 1: 209 (1963) and U.S. Pat. Nos., 4,678,550, 4,648,951, and 4,514,363, the teachings of which are hereby incorporated herein by reference.

Effluent mercury from, for instance, a $^{196}Hg$ photochemical enrichment process, usually contains trace amount of particulate mercurous chloride, $Hg_2Cl_2$. Since in commercially viable enrichment processes the mercury effluent is typically recycled, it is desirable to remove this particulate $Hg_2Cl_2$ so that the Hg effluent can be re-used.

The present invention is directed to one such method for collecting particulate contaminated mercury and for thereafter removing the particulate contaminants. The present invention is especially directed to a method of purifying mercury feedstock containing particulates such as $Hg_2Cl_2$. The present invention thus comprises the use of aliphatic ketones for the collection of contaminated mercury, and a simple mechanical filtering process which involves passing the contaminated mercury through narrow bore glass tubing on which the $Hg_2Cl_2$ adheres.

The present invention is based in part upon the discovery that lower alkyl ketones (RCOR, each R=independently $C_1$-$C_6$ alkyl), particularly dimethyl ketone, $CH_3COCH_3$, may be effectively used to recover liquid Hg dispersed on surfaces of vessels containing condensed Hg. Moreover, the use of an ultrasonic bath may assist in such Hg recovery.

Figure 1:
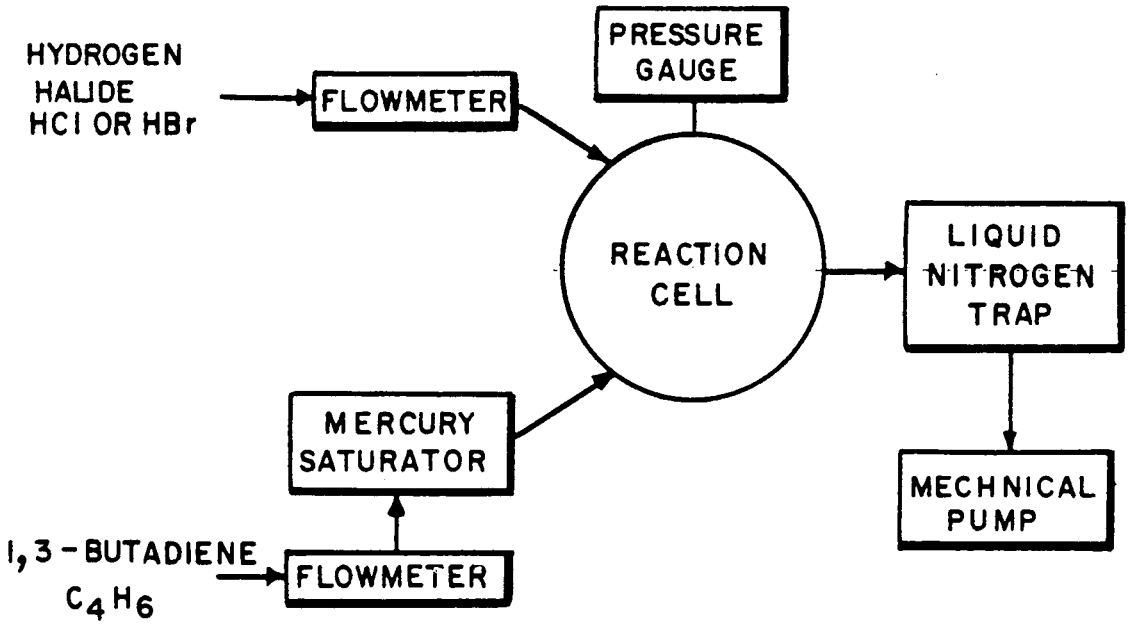
FIG. 1 PRIOR ART
FIG. 1 is a schematic of the mercury photochemical separation apparatus of Webster and Zare, *J. Phys. Chem.*, 85: 1302–1305 (1981).
Figure 2:
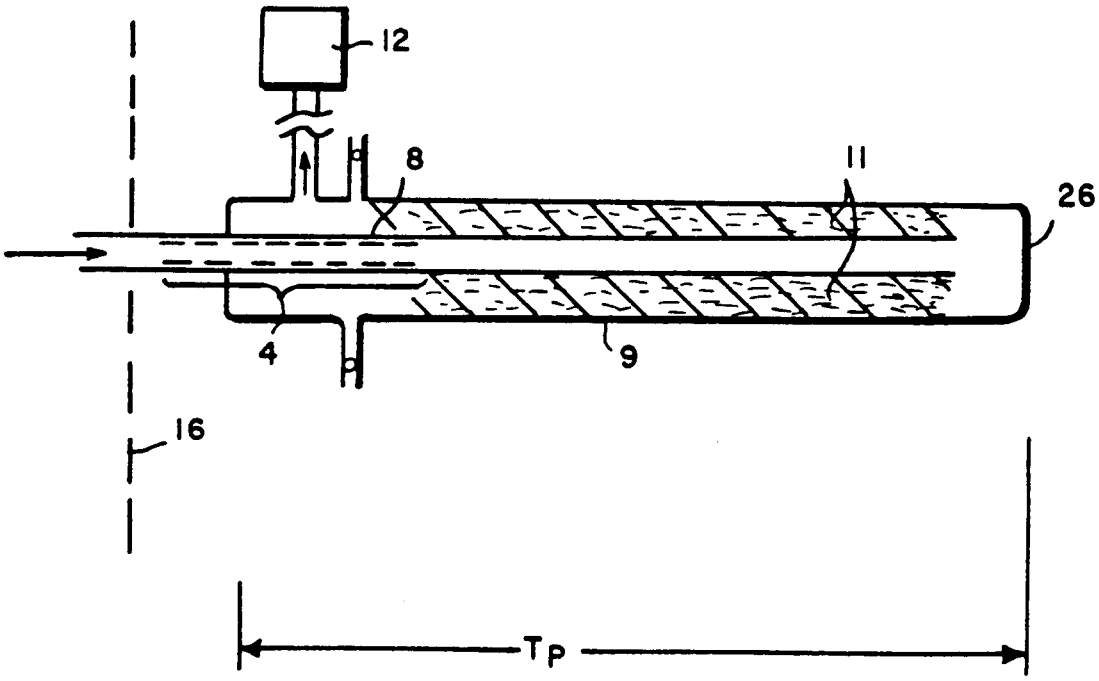
FIG. 2 shows a schematic of the mechanical vacuum trap of the present invention.

During the transfer of mercury in the vapor phase it will often condense over a wide surface area within its containing vessel. In FIG. 2 there is illustrated one type of $^{196}Hg$ enrichment effluent collection system. Typically, a liquid nitrogen cold trap 10 is used to collect the mercury and other condensables. After the more volatile effluent components escape as the trap warms to room temperature the remaining mercury is dispersed over the inside walls of the cold trap.

Figure 3:
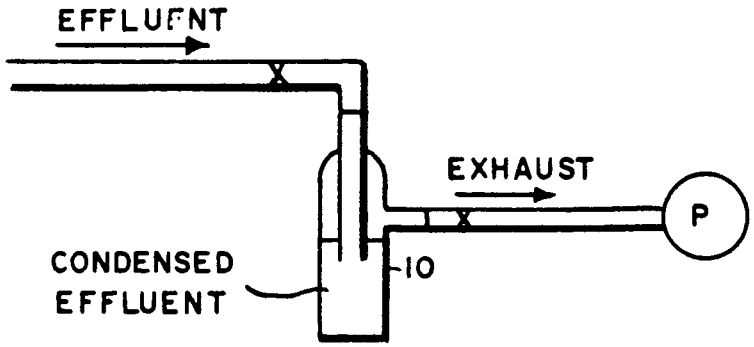
FIGS. 3 and 4 illustrate two different types of mercury enrichment effluent collection systems which can be improved by the purification techniques of the present invention.

A similar effect occurs in the collection system illustrated in FIG. 3. Here mercury coated wires (obtained from electrolytic plating, for example) are placed inside a tube 20 with a valve assembly 22 at one end. The end without the valve is flame sealed after the entire tube is evacuated and backed filled with about 300 Torr Argon.

As shown in FIG. 3, the section of the tube containing the Hg coated wires is placed in an oven 24 and heated to about 400° C. Mercury is transferred from the coated wire to a cool region 26 outside the oven. The entire assembly is then removed from the oven and a sealing means, e.g., gas flame, is used to section off the region containing the wires at point 28. In this way only elemental Hg remains within the valve assembly region.

Prior to the ketone collection method of the present invention, concentrated nitric acid would be used in both of the above-described embodiments to dissolve the condensed Hg. For instance, in order to obtain a Hg sample for quantitative analysis such as isotopic abundance, electrolytic separation would be carried out using a fraction of the nitric acid and Hg solution. For a quantitative measure of how much mercury is present, potentiometric titration would be carried out.

It has been discovered that for large enough quantities, a simpler method is suitable, namely, the ketone collection technique of the present invention.

In the case of FIG. 2 sample sizes of greater than or equal to from about 20 to 100 grams and in the case of FIG. 3, sample sizes greater than or equal to from about 0.5 to 2 mg are large enough to effectively use the ketone collection technique of the present invention.

A lower alkyl ($C_1$-$C_6$) ketone, especially acetone, and advantageously, Fisher Scientific Histological Grade Acetone, is poured into the vessel after other condensables have evaporated. The weight of the condensed Hg causes it to roll off of the wall surface. Ultrasonic agitation has been found to be an especially effective means of combining the individual droplets.

In the case Of effluent recovery, for example, when using HCl as a carrier gas, a dark residue forms with the Hg. Under such conditions, several acetone rinses and ultrasonic agitation cycles are effective in recovering the mercury from the dark residue compound (or mixture). The mercury is then easily separated by carefully pouring away the residual acetone. As much as gram quantities of Hg have been recovered in this manner.

In addition to the ketone collection system of the present invention, a pretrap has been designed for use as an additional means for collecting condensed mercury from enrichment effluent. This pretrap is illustrated in FIG. 4.

Figure 4:
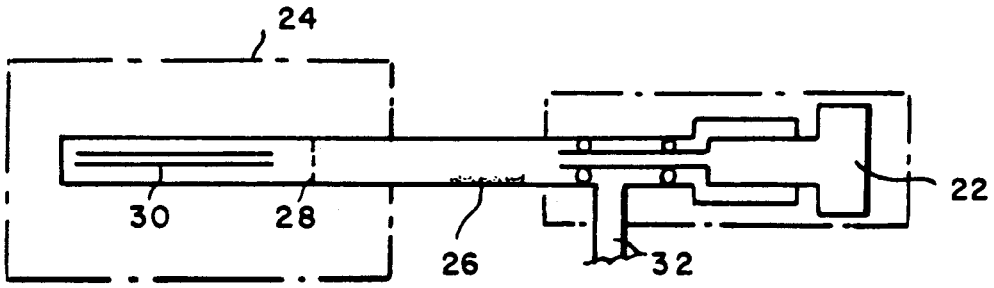

The mechanical vacuum trap of FIG. 4 is kept close to room temperature and is advantageously used to remove a large fraction of mercury from the effluent flow before use of liquid nitrogen traps. The trap of the present invention has been designed so that condensable product from the photochemical reactor is removed upstream of the Hg deposit. The Hg deposit is preferably collected via an acetone rinse as described above, and is free of particulates.

FIG. 4 shows a schematic of the pretrap of the present invention. This pretrap 30 is used upstream of one or more liquid nitrogen ($LN_2$) traps 32 to separate condensable product 34 that escapes from the reaction zone 36 and the effluent Hg 38 from the carrier gas stream.

In one preferred embodiment, the pretrap 30 was from 15 to 20 inches in length, and about 3 inches in outer diameter. As illustrated, the trap 30 comprises two concentrically arranged glass tubes, a smaller (inner) tube 8 about 12"×1"and a larger (outer) tube 9 about 20"×3". Space between the tubes is preferably filled with glass packing. The temperature within the trap is designated $T_p$. It has been found that for $T_p \sim 30°$ C., most of the effluent Hg condenses at the point 26 as shown in FIG. 4.

The condensed mercury is preferably collected via the acetone rinse method as set forth above. The condensed product can be recovered via electrolytic methods or discarded.

As illustrated in FIG. 4, particulate $Hg_2Cl_2$ collects in tube 8 at point 4. The condensed mercury is thus free of particulates and in the case of the feedstock having a high enough initial $Hg^{196}$ concentration this effluent Hg may contain enough $Hg^{196}$ so it can be re-used as feedstock for another pass. By lowering $T_p$ it should be possible to capture close to 100% of the effluent Hg. This means that in those cases when hydrogen chloride gas is used as a carrier gas, the $LN_2$ traps will contain only HCl, thus permitting ready recycling of the carrier gas.

In certain cases, the collected mercury may contain particulate contaminants such as $Hg_2Cl_2$. These particulates may be removed by using the mechanical filtering apparatus illustrated in FIG. 5.

Figure 5:
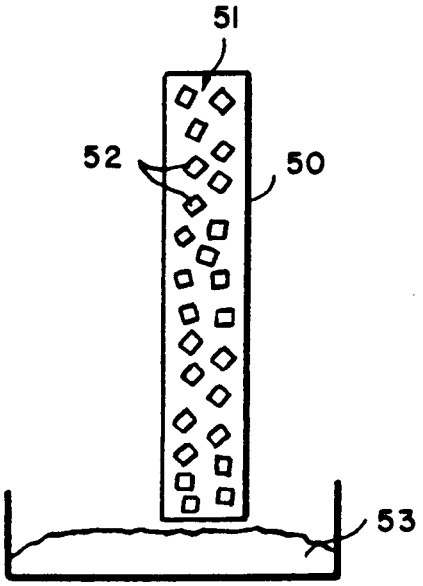
FIG. 5 illustrates the preferred mechanical filtering apparatus of the present invention, useful for refining particulate contaminated mercury, especially $Hg_2Cl_2$ particulates.

Referring in detail to FIG. 5, the preferred mechanical filtering means of the present invention is shown. After the contaminated mercury is collected from the effluent, particularly by using the preferred acetone system described supra, it is passed through a glass tube 1 to 2 mm ID and 50 mm long. This may be repeated several times in order to convert the Hg liquid from a dull grey to normal Hg surface, i.e.. shinning silver. The residue on the tube may contain a small quantity of Hg but is typically much less than 10% of the total Hg passed through.

Batch quantities of 10 g have been cleaned in this way. Larger quantities can be handled by simple changes in the apparatus i.e., longer tubes, multiple tubes, etc.

The above method is simple, effective and less costly than previously used purification methods, e.g., vapor distillation methods.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A process for the purification of the effluent formed in a photochemical enrichment reactor during the operation thereof for the photochemical isotope enrichment of mercury for the production of the $^{196}Hg$ isotope, which comprises separating the effluent, which contains both $^{196}Hg$ and one or more of the particulate mercury compounds selected from the group consisting of $Hg_2Cl_2$ and HgO, by mechanical means.

2. The process of claim 1, wherein the method of effecting the separation of the effluent from the enriched $^{196}Hg$ includes passing the effluent through a mechanical filtering medium comprising a plurality of thin glass tubes.

3. The process of claim 1 or 2, which further includes the addition of a lower alkyl ketone, as a wash solution in said photochemical reactor to assist in the collection of the effluent, prior to its separation from any particulate contaminants.

4. The process of claim 3, which further comprises the addition of ultrasonic means to assist in the ketone wash.

5. The process of claim 3, wherein said lower alkyl ketone is dimethyl ketone (acetone).

* * * * *